US009802422B2

(12) United States Patent
Klocke et al.

(10) Patent No.: US 9,802,422 B2
(45) Date of Patent: Oct. 31, 2017

(54) PRINTER FOR PRINTING OF PRINTABLE OBJECTS AND INK RIBBON CASSETTE FOR USE IN A PRINTER

(71) Applicant: Phoenix Contact GmbH & Co. KG, Blomberg (DE)

(72) Inventors: Sandra Klocke, Vlotho (DE); Kilian Klages, Detmold (DE); Albrecht Schierholz, Schieder-Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 15/410,248

(22) Filed: Jan. 19, 2017

(65) Prior Publication Data

US 2017/0210140 A1 Jul. 27, 2017

(30) Foreign Application Priority Data

Jan. 22, 2016 (DE) ..... 10 2016 101 137

(51) Int. Cl.
*B41J 32/00* (2006.01)
*B41J 25/304* (2006.01)
*B41J 2/325* (2006.01)

(52) U.S. Cl.
CPC ..... *B41J 2/325* (2013.01); *B41J 32/00* (2013.01); *B41J 25/304* (2013.01)

(58) Field of Classification Search
CPC ..... B41J 17/32; B41J 3/36; B41J 3/407; B41J 32/00; B41J 25/304; B41J 25/34; B41J 29/02; B41J 35/28
See application file for complete search history.

(56) References Cited

U.S. PATENT DOCUMENTS 4,641,980 A * 2/1987 Matsumoto ..... B41J 15/042 346/136
4,910,602 A 3/1990 Sakuragi
5,248,207 A * 9/1993 Yamamoto ..... B41J 17/32 400/120.16
5,255,015 A * 10/1993 Noethen ..... G02B 6/4204 347/247

(Continued)

FOREIGN PATENT DOCUMENTS

DE 694 14 539 T2 4/1999
EP 1 829 696 A2 9/2007
WO 2009/152360 A1 12/2009

*Primary Examiner* — Huan Tran
(74) *Attorney, Agent, or Firm* — David S. Safran

(57) ABSTRACT

A printer includes: a housing, a print space within the housing, a print head, a replaceable ink ribbon cassette, a receiving device for a printable object which is to be printed, a control and evaluation unit, and an input and display apparatus. The receiving device can travel between a loading and unloading position outside the print space and a print position within the print space.

A print head holder on whose bottom the print head is attached is pivotably mounted in the housing. In the closed position of the print head holder the print head is located in a working position above the ink ribbon cassette. In a swung-up position of the print head holder an ink ribbon cassette can be inserted into the housing or can be removed from the housing. At least one spring arm is formed on the top of the ink ribbon cassette or on the bottom of the print head holder.

12 Claims, 6 Drawing Sheets

(56) References Cited

U.S. PATENT DOCUMENTS

| | | | | |
|---|---|---|---|---|
| 5,393,149 | A | 2/1995 | Iima | |
| 5,451,996 | A | 9/1995 | Awai et al. | |
| 5,620,265 | A | 4/1997 | Kondo | |
| 6,414,704 | B1 * | 7/2002 | Yamashita | B41J 15/042 347/222 |
| 2015/0283835 | A1 * | 10/2015 | Sakano | B41J 3/4075 347/214 |
| 2015/0283836 | A1 * | 10/2015 | Sakano | B41J 3/4075 347/214 |

* cited by examiner

PRINTER FOR PRINTING OF PRINTABLE OBJECTS AND INK RIBBON CASSETTE FOR USE IN A PRINTER

BACKGROUND OF THE INVENTION

Field of the Invention

The invention relates to a printer for printing of printable objects for identification of electrical components, with a housing, with a print space which is made within the housing, with a print head, with a replaceable ink ribbon cassette which has an ink ribbon, with a receiving device for a printable object which is to be printed, with a control and evaluation unit and with an input and display apparatus, and the receiving device can travel between a loading and unloading position outside the print space and a print position within the print space.

Description of Related Art

In industrial and commercial practice, for marking and labeling of machinery, devices, terminals, cables or leads, different types of marking and identification labels are used on which information is applied relating to the components to which they are assigned. To do this the marking and identification labels in a printer are provided with a corresponding print pattern, generally alphanumeric characters. Different printers with different printing methods are used for identification, for example inkjet printers, thermotransfer printers or UV printers. These identification printers are known for example from the catalog "Identification Systems Tools Installation Material, 2013/2014", pages 28 to 37 of Phoenix Contact GmbH & Co. KG.

In practice, printable objects in card format which have a plurality of individual identification labels are often used. The printable items are made in particular as plastic injected parts or as plastic stamped parts. In plastic injected parts which are also called Universal Card Material (UniCard or UC Material) the identification labels are fastened via webs in an outer frame. After printing, the individual identification labels which are often used for the identification of leads and cables and for clamp identification are separated from the frame. For plastic stamped parts which are also called Universal Sheet Material (UniSheet or US Material) several rows of identification labels together form a printable object, and after printing of the US material the individual identification labels can be separated from one another.

Moreover several marking and identification labels can also be applied, in particular cemented, on a common carrier sheet, from which the individual marking and identification labels can be easily pulled off after identification. In practice these carrier sheets are also called lettering sheets and label sheets.

The different types of labeling materials are generally called printable objects below, and the printable objects can consist of different materials, in particular different plastics, and can have different dimensions, especially different material thicknesses. In order to be able to print printable objects with different dimensions by a printer, the individual printable objects are preferably not directly inserted into the receiving device, but into a magazine which is suitable for the printable object and which is inserted into the receiving device. Generally several printable objects can be inserted individually into a magazine so that the numbers of printable objects is larger than the number of magazines. If all magazines have the same outside dimensions, the magazines can each be inserted into the receiving device of the printer which can be moved in the manner of a drawer between a loading and unloading position outside the print space and a print position within the print space.

To print these printable objects, thermotransfer printers have turned out to be especially suitable. In thermotransfer printing a special film which is coated with temperature-sensitive inks is routed through between the printable object and a thermoprint head, and the film as an ink ribbon can be located in a corresponding printer cassette. With thermotransfer printing an exact ink impression and high print quality with high surface gloss can be produced. But for this purpose it is necessary that the print parameters such as the temperature, print speed, material and thickness of the printable object and of the ink ribbon are exactly matched to one another.

With the printer under consideration which is preferably a thermotransfer printer, a plurality of different printable objects are to be able to be printed. For the printer there are then a plurality of different magazines which can be inserted into the receiving device. Moreover several different printer cassettes with different ink ribbons are also to be able to be used.

In a portable thermotransfer printer known from practice the housing has an essentially L-shaped fixed housing part and a housing hood which is pivotably attached laterally to the top of the fixed housing part. Underneath the pivotable housing hood there is a holder for the ink ribbon which consists of two shafts. One shaft is used to hold the main spool with the ink ribbon wound onto it and the other spool is used to hold the take-up spool. To insert a new ink ribbon, first the housing hood must be swung up so that the main spool can be slipped onto the first shaft. Afterwards the free end of the ink ribbon must be pulled off the main spool and attached to the take-up spool, and the ink ribbon must be guided past the print head by a guide. Altogether the insertion of a new ink ribbon is thus associated with effort, and it must be watched that the ink ribbon is properly routed past the print head and attached to the take-up spool.

DE 694 14 539 T2 corresponds to U.S. Pat. No. 5,620,265 discloses an ink ribbon cassette which can be inserted as a whole in a corresponding receiver in a printer. The ink ribbon cassette has a main spool, a feed spool and an ink ribbon. The ink ribbon is wound around the main spool, the free end of the ink ribbon being connected to the take-up spool onto which it is wound during printing. The two spools with the ink ribbon are located in a cassette body which consists of a lower shell for holding the two spools and a shell-shaped cover. In the lower shell of the cassette body a window is formed which is located between the two spools so that printing of a printable object which is located underneath the window is possible when the print head is located above the ink ribbon between the two spools.

When using this ink ribbon cassette the replacement of the complete ink ribbon cassette can be easily performed, but to ensure the optimum distance between the print head and the ink ribbon very exact positioning of the spools in the cassette body and of the cassette body in the housing of the printer and also of the print head relative to the cassette body is necessary to ensure that the print head has a given distance to the ink ribbon in the course of printing.

SUMMARY OF THE INVENTION

Therefore the object of this invention is to devise a printer as described initially for printing of printable objects for the identification of electrical components, in which the use of an ink ribbon is associated with little effort and at the same time it is ensured that in print operation the ink ribbon has a given distance to the print head. Moreover an ink ribbon cassette is to be made available which makes it possible for the ink ribbon cassette to be reliably located in its given position within the printer with easy replaceability.

This object is achieved in the printer as claimed in the invention in that the print head holder on whose bottom the print head is attached is pivotably mounted in the housing such that in the closed position of the print head holder the print head is located in a working position above the ink ribbon of the ink ribbon cassette and in a swung-up position of the print head holder an ink ribbon cassette is inserted into the housing or can be removed from the housing. The arrangement of the print head on a print head holder which is pivotably mounted in the housing first of all makes it very easily possible to move the print head out of its working position into a second position in which the insertion of an ink ribbon cassette into the housing or the removal of the ink ribbon cassette from the housing is easily possible. If the print head holder is made stable enough, by the arrangement of the print head on the print head holder it is also ensured that the print head in its working position is always in the same position within the printer.

In the printer as claimed in the invention it is moreover provided that on the top of the ink ribbon cassette or on the bottom of the print head holder at least one spring arm is formed which is deflected in the closed position of the print head holder such that the ink ribbon cassette has a given distance to the print head. By forming at least one spring arm on the top of the ink ribbon cassette or on the bottom of the print head holder, production-dictated differences in the dimensions of the individual replaceable ink ribbon cassettes are thus equalized so that overly great demands are not imposed on the individual ink ribbon cassettes with respect to their dimensions. Since by the formation at least one spring arm the distance between the free end of the print head and the ink ribbon moves within a certain tolerance range, it is easily ensured that an exact ink impression and high print quality can be achieved.

It was stated above that at least one spring arm is formed on the top of the ink ribbon cassette or on the bottom of the print head holder. But fundamentally at least one spring arm can also be formed both on the top of the ink ribbon cassette and also on the bottom of the print head holder. According to one preferred configuration it is however provided that at least two, preferably four spring arms are formed on the top of the ink ribbon cassette. For this purpose the ink ribbon cassette has an ink ribbon, a main spool with a cover, a feed spool with a cover and a cassette body, on the two covers of the two spools at least one spring arm, preferably two spring arms, being formed. Even if the two covers are each assigned one spool, the covers need not be made as individual components, but also can be connected to one another.

The spring arms are preferably especially easily implemented by their being stamped out of the top of the covers so that the spring arms are joined integrally to the cover of the ink ribbon cassette or of the spools. The spring arms are made such that in the undeflected state of the spring arms the free end of the respective spring arms projects over the top of the corresponding cover.

If an ink ribbon cassette made in this way is inserted in the housing of the printer, there is contact between the free ends of the spring arms and the bottom of the print head holder when the print head is in its working position, i.e., when the print head holder has been swung down. The print head holder in the swung-down state thus presses on the spring arms which have been formed in the ink ribbon cassette, as a result of which the spring arms are somewhat deflected and thus the ink ribbon cassette is moved into a given spaced position to the print head which is attached to the print head holder.

So that the print head is reliably fixed in its working position, there is at least one locking lever which can be moved out of a first position in which the print head holder is locked in the closed position into a second position in which the print head holder can be swung. Preferably on either side of the print head holder there is one locking lever so that the print head holder in the closed position is not exposed to a force on one side, but uniformly. The locking levers each preferably have a latch hook which in the locked position extends under a corresponding latch projection which is made in the housing.

By forming at least one spring arm, preferably on the top of the ink ribbon cassette, the position of a replaceable ink ribbon cassette relative to the position of the print head can be easily and at the same time reliably fixed. To ensure a good print image with a high print quality and an exact ink impression it is not only important for the distance between the print head and the ink ribbon to be within a certain relatively narrow range, but other print parameters such as the temperature and the print speed should moreover also be matched to the ink ribbon used at the time.

To do this, according to another advantageous configuration of the invention, in the housing there is at least one optical sensor for detecting a marking which is located on the ink ribbon cassette. Based on the marking which has been detected by the sensor it can then be ascertained by the evaluation unit which ink ribbon cassette has been inserted into the printer so that for example it can be checked whether the inserted ink ribbon cassette is suitable at all for the intended print task, i.e., for the printing of the selected and inserted printable object. Moreover the recognition of the inserted ink ribbon cassette which has taken place by way of the optical sensor can also be used to match the temperature of the print head and/or the printing speed to the inserted ink ribbon cassette. Because in the printer as claimed in the invention the position of the ink ribbon cassette within the printer is always very exactly fixed by the formation of the spring arms it is at the same time also ensured that the marking which is located on the ink ribbon cassette is located within the detection range of the optical sensor. The marking can preferably be a bar code marking which has several individual lines which are located next to one another, each with a given length and width. The individual lines are then preferably either black or white. The at least one optical sensor can then preferably be a reflex light scanner, either one sensor being used which is moved past the individual marks, or several sensors being located next to one another.

The exact positioning of the ink ribbon cassette within the printer housing also ensures that a gear which is connected to the feed spool of the ink ribbon cassette is located very precisely to a drive gear which is located in the print housing so that the two gears mesh exactly with one another. This prevents damage to the gears by excessive abrasion so that there are no special demands on the gears with respect to their strength. The gears can thus for example consist of plastic.

According to another advantageous configuration of the invention, in the housing there is at least one further optical sensor which is used to detect the rotary motion of a slotted sensor wheel which is connected to the main spool of the ink ribbon cassette. This optical sensor is preferably a photoelectric barrier with which rotary motion of the sensor wheel and thus the transport of the ink ribbon can be ascertained by the formation of corresponding slots in the sensor wheel.

So that in the printer as claimed in the invention an ink ribbon cassette can be inserted or replaced, it is necessary that the ink ribbon cassette be accessible to the user as easily as possible. This is preferably implemented in the printer as claimed in the invention by the housing having a lower part and an upper part which is pivotably connected to the lower part, in the lower part of the housing the print space, the print head, the ink ribbon cassette, the receiving device and the control and evaluation unit being located. The upper part of the housing conversely has essentially only the input and display apparatus which is made as a tablet computer according to one especially preferred configuration.

The pivoting capacity of the upper part of the housing on the lower part of the housing makes it possible for the upper part of the housing to be easily swung up so that then in particular the print head which is located in the lower part of the housing and the print head holder which can be pivoted in the lower part of the housing are accessible to the user. When the upper part of the housing has been swung up the user can swing the print head holder up out of the closed position into the opened position and then can remove an ink ribbon cassette from the lower part of the housing or insert a new ink ribbon cassette into the receiver which is made in the lower part of the housing for the ink ribbon cassette.

In an ink ribbon cassette with an ink ribbon, a main spool, a feed spool and a cassette body, the main spool and the feed spool each being covered by a cover, the aforementioned object is achieved by at least one spring arm being formed on each of the two covers, the free end of the spring arms in the undeflected state of the spring arms extending above the top of the cover. Preferably the spring arms are stamped out of the top of the covers so that the spring arms are connected integrally to the respective covers. With respect to the advantages of the ink ribbon cassette, reference is made to the statements above in conjunction with the printer as claimed in the invention.

According to one advantageous configuration of the ink ribbon cassette the feed spool is connected to a gear which can be driven by a drive gear which is located in the printer housing. In this way the transport of the ink ribbon via a motor located in the printer as well as the drive gear which is connected to the motor can be easily adjusted and controlled. According to another advantageous configuration of the ink ribbon cassette the main spool is connected to a slotted sensor wheel so that the transport and optionally also the transport speed of the ink ribbon can be easily ascertained and measured by means of an optical sensor which is located in the housing.

In particular there is now a plurality of possibilities for configuring and developing the printer according to the invention and the ink ribbon cassette as will be apparent from the following description of preferred exemplary embodiments in conjunction with the accompanying drawings.

DETAILED DESCRIPTION OF THE INVENTION

Figure 1:
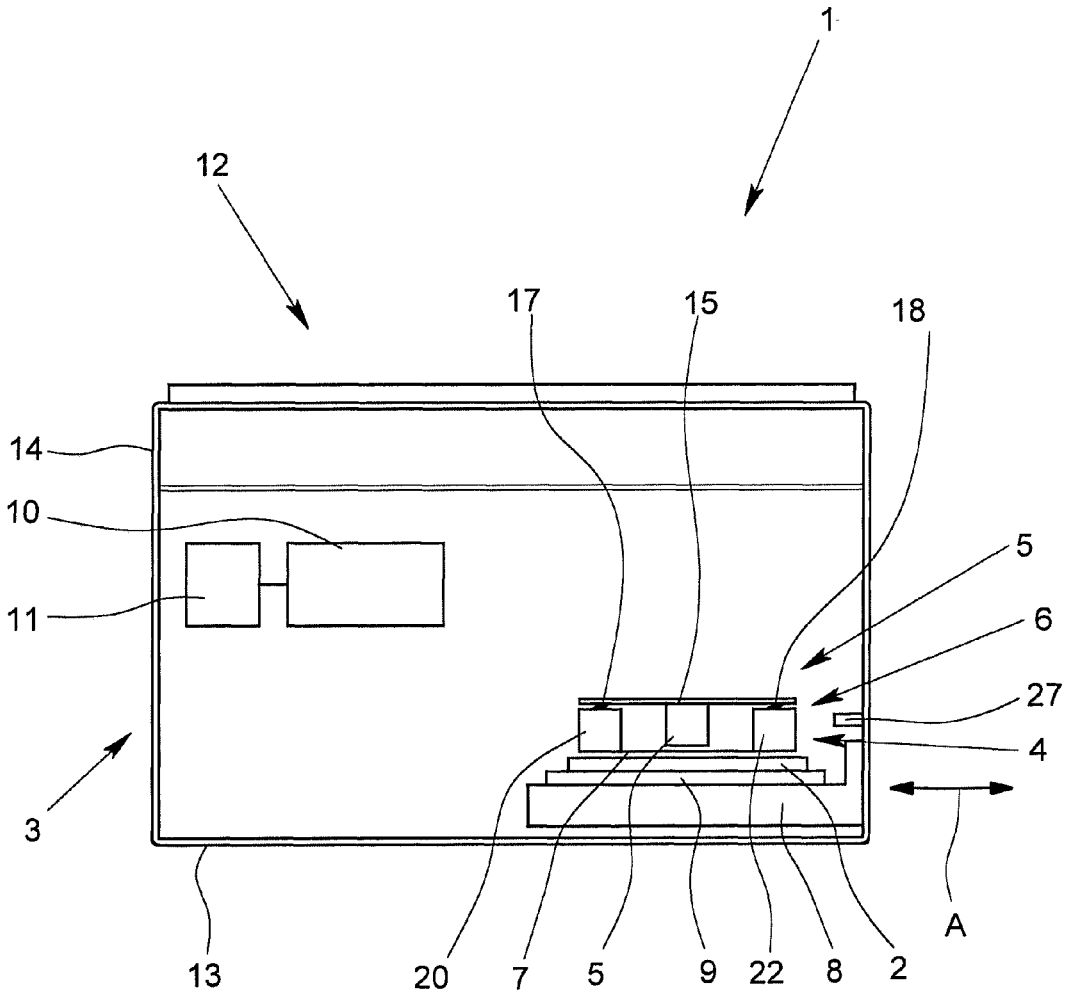
FIG. 1 shows a schematic of a printer in a longitudinal section.

FIG. 1 shows a printer 1 according to this invention in a highly simplified schematic in a longitudinal section. The printer 1 which is preferably a thermotransfer printer is used to print printable objects 2, in particular in card format or in the form of carrier sheets. The printer 1 has a housing 3 in which a print space 4 is formed. Moreover in the housing 3 there are a print head 5 and an ink ribbon cassette 6 whose ink ribbon 7 in the print process is located a very short distance above the printable object 2 which is to be printed. A receiving device 8 which is made in the manner of a drawer or a transport carriage can be moved between a loading and unloading position outside the print space 4 and a print position within the print space 4. In FIG. 1 the direction of movement of the receiving device 8 runs in the direction of arrow A, in the representation according to FIG. 1 the receiving device 8 being located within the print space 4, therefore in the print position. The receiving device 8 is used to accommodate a magazine 9 into which the printable object 2 which is to be printed can be inserted. This ensures that the printable object 2 which is to be printed can be easily and comfortably placed in the print space 4 and can also always be located there in a given position.

To control the print process, in the printer 1 there are moreover in particular a control and evaluation unit 10 as well as a memory 11 which is connected to the control and evaluation unit 10, which are shown schematically in FIG. 1. Moreover the printer 1 has another input and display apparatus 12 which in the preferred configuration of the printer 1 is formed by a tablet computer. The control and evaluation unit 10 is moreover also connected to the print head 5 and the input and display apparatus 12; however this is not shown in FIG. 1. As is indicated in FIG. 1 and as is apparent in particular in FIG. 2, the housing 3 has a lower part 13 and an upper part 14. In the lower part 13 of the housing there are the print space 4, the print head 5, the ink ribbon cassette 6, the receiving device 8 and the control and evaluation unit 10, as well as the memory 11. The input and display apparatus 12 is conversely connected to the upper part 14 of the housing.

Figure 2:
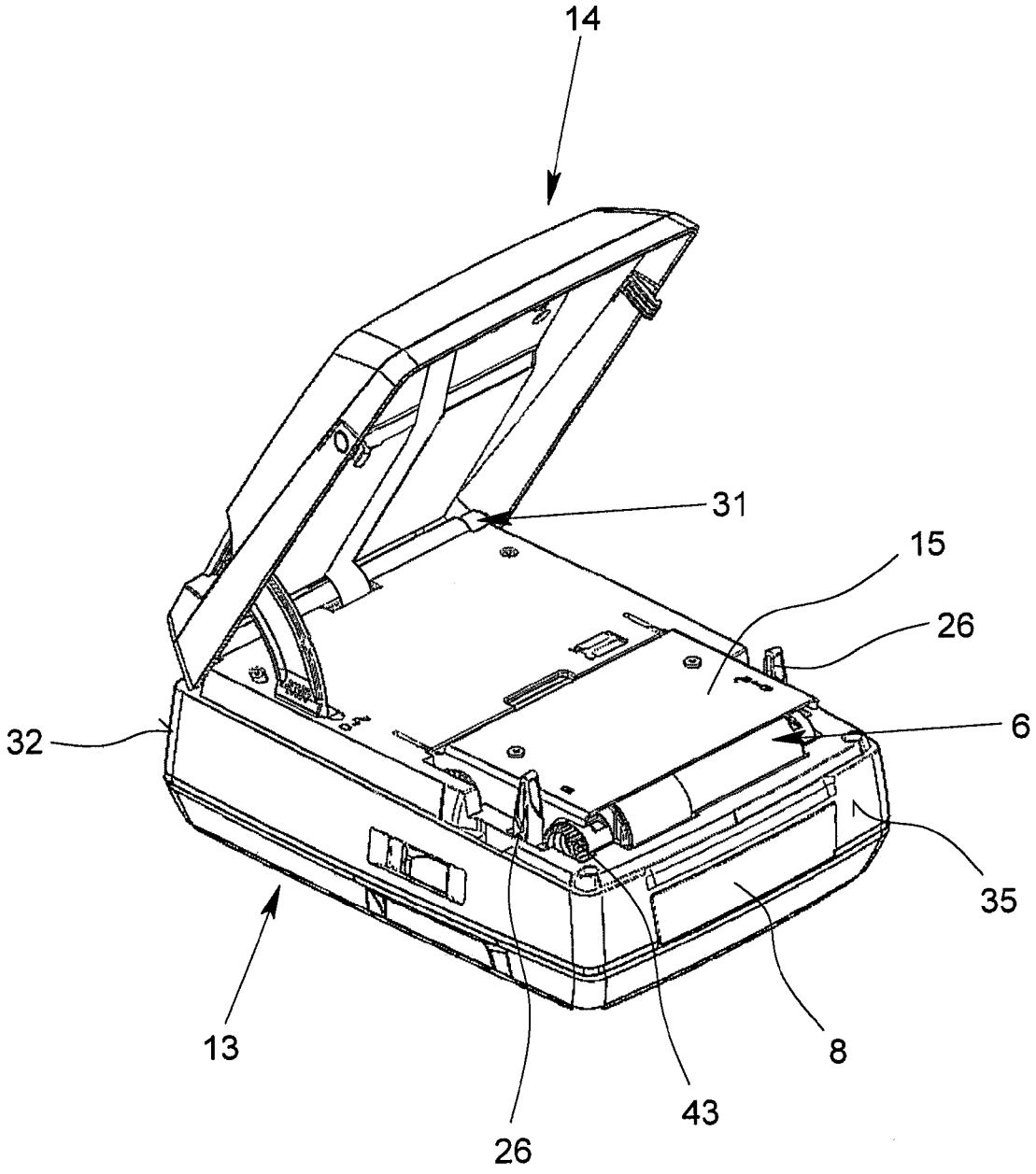
FIG. 2 shows a perspective of one preferred exemplary embodiment of the printer, obliquely from the front, with the upper part of the housing swung up.
Figure 3:
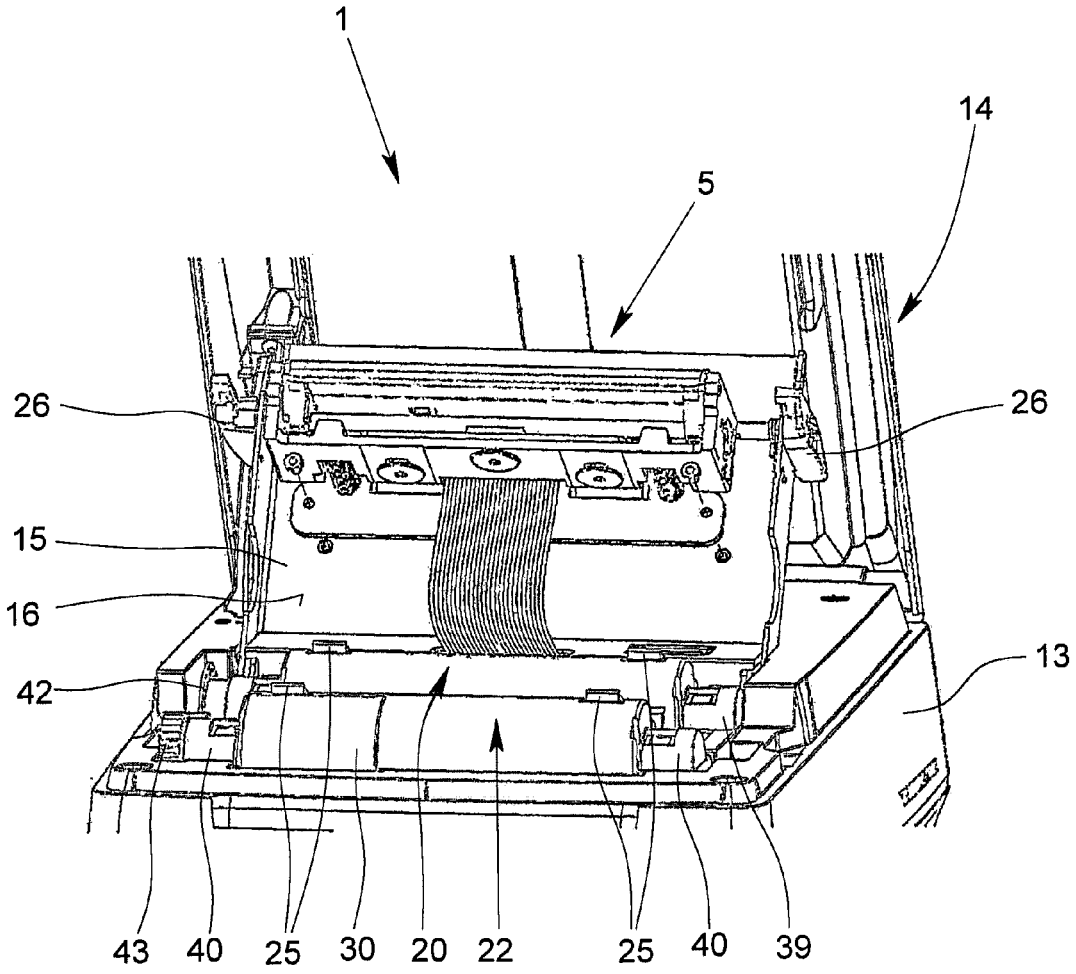
FIG. 3 shows an enlarged extract of the printer according to FIG. 2 with the print head holder swung up.
Figure 4:
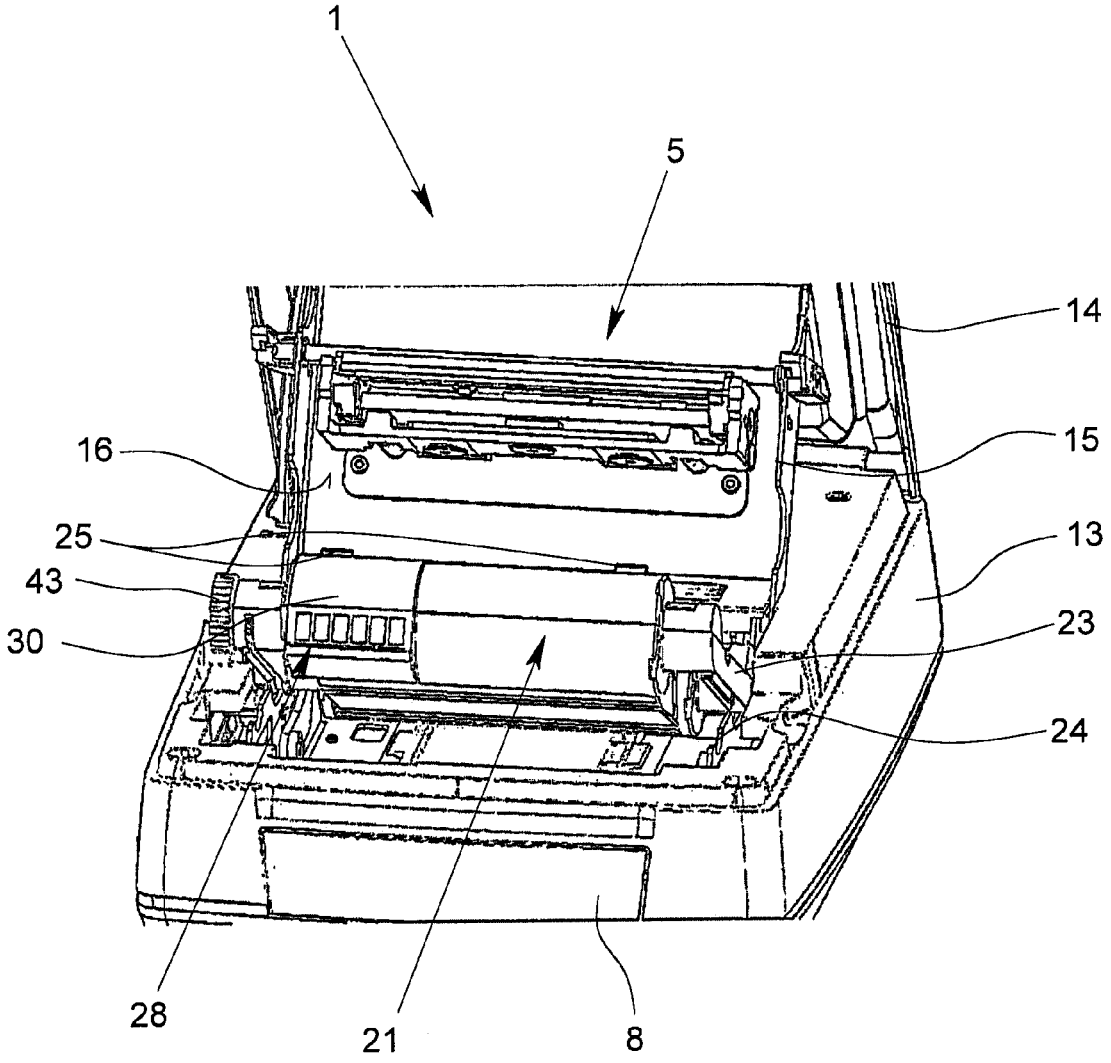
FIG. 4 shows a further extract of the printer according to FIG. 2 with the print head holder swung up and the ink ribbon cassette lifted.

In the printer 1 as claimed in the invention a print head holder 15 is pivotably mounted in the housing 3 or in the lower part 13 of the housing, on whose bottom 16 the print head 5 is attached. The print head 5 thus can be easily moved out of its working position which is shown in FIGS. 1 and 2 and in which the print head 5 is located above the ink ribbon 7 into an installation position which is shown in FIGS. 3 and 4, by the print head holder 15 being swung up out of its closed position into an opened position. In the swung-down and locked state of the print head holder 15 the bottom 16 of the print head holder 15 presses on the spring arms 17, 18 which are formed on the top of the ink ribbon cassette 6.

Figure 6:
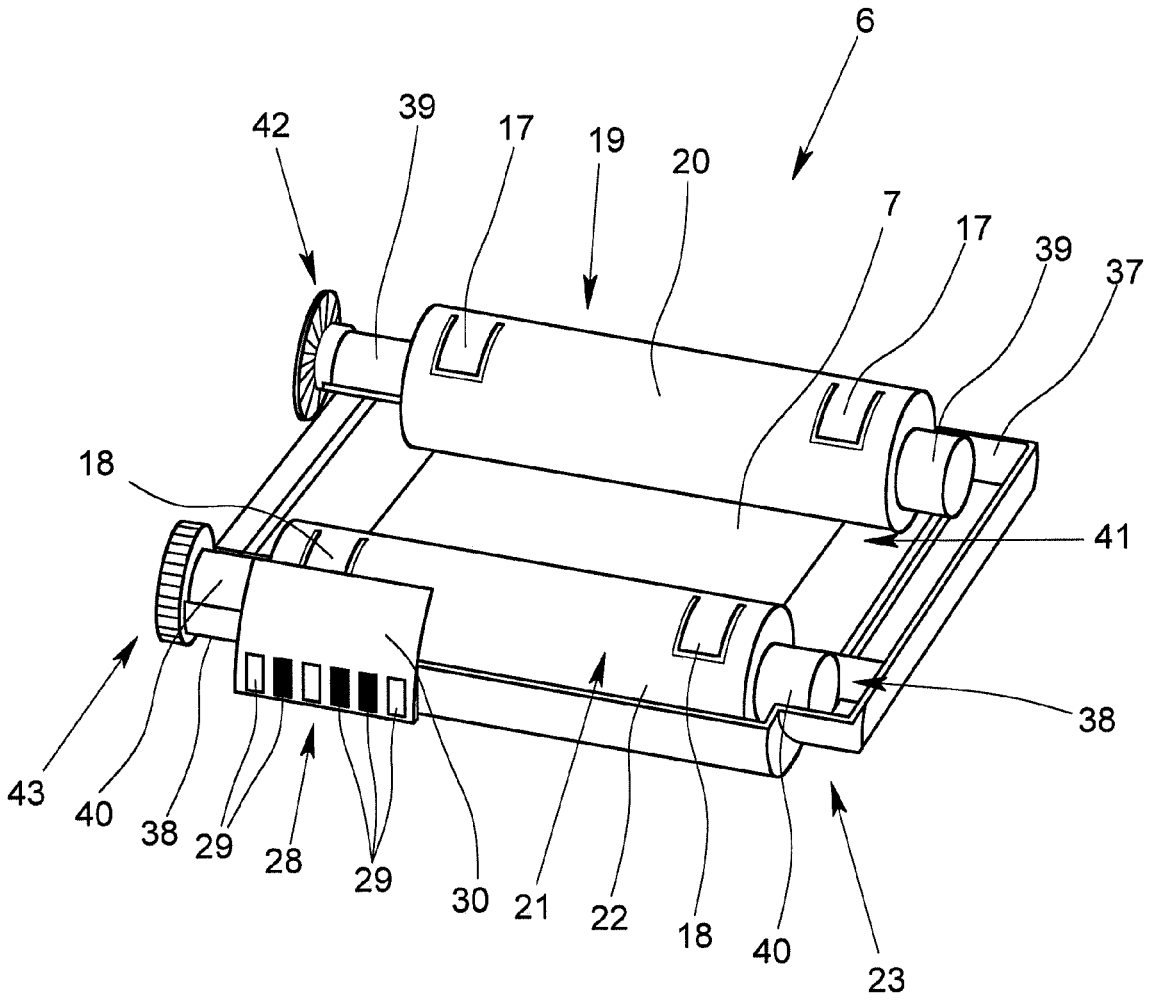
FIG. 6 shows one preferred exemplary embodiment of an ink ribbon cassette in a perspective.

As is apparent from FIGS. 3, 4 and 6, the ink ribbon cassette 6 has a main spool 19 and a feed spool 21 which each have a cover 20, 22. In this way the ink ribbon 7 which is being wound in print operation from the main spool 19 onto the feed spool 21 is protected by the covers 20, 22 in the region of the two spools 19, 21. Moreover the ink ribbon cassette 6 still has a cassette body 23 which is used to accommodate and support the main spool 19 and the feed spool 21 and to insert the ink ribbon cassette 6 into a corresponding holder 24 in the housing 3 of the printer 1. The covers 20, 22 are moreover used for simple execution of the spring arms 17, 18.

In the preferred exemplary embodiment of the printer 1 and of the ink ribbon cassette 6 which is shown in the figures, on the cover 20 of the main spool 19 two spring arms 17 are made and on the cover 22 of the feed spool 21 two spring arms 18 are also made, the spring arms 17, 18 each being stamped out of the covers 20, 22 by a U-shaped undercut. The spring arms 17, 18 are thus connected integrally to the covers 20, 22 so that additional components are not required for the spring arms 17, 18. The spring arms 17, 18 are formed in pairs opposite one another on the two spools 19, 21 so that the spring arms 17, 18 are made altogether symmetrically on the ink ribbon cassette 6. As is especially apparent from FIG. 3, the individual spring arms 17, 18 are made such that their free ends 25 in the undeflected state of the spring arms 17, 18 extend above the top of the covers 20, 22.

So that the print head 5 is reliably fixed in its working position, there are at least two locking levers 26 which in the illustrated exemplary embodiment are located laterally on the print head holder 15. The locking levers 26 interact with projections which are located in the lower part 13 of the housing so that the print head holder 15 can be locked in the closed position. By tilting the two locking levers 26 the locking to the projections in the lower part 13 of the housing is released so that the print head holder 15 can be swung up into the second position (FIG. 3). In this position of the print head holder 15 the ink ribbon cassette 6 can be easily lifted out of the lower part 13 of the housing, for example the ink ribbon cassette 6 being first tilted somewhat, as is shown in FIG. 4.

In one preferred embodiment of the printer 1 as claimed in the invention, in the housing there are several sensors 27 for detecting a marking 28 which is attached to the ink ribbon cassette 6. To detect the marking 28 of the ink ribbon cassette 6 which is made as a bar code, there are preferably several optical sensors 27 in the longitudinal extension of the marking 28 next to one another in the lower part 13 of the housing. The optical sensors 27 which are located in succession in the plane of the drawing according to FIG. 1 are each used to detect an individual line 29 of the bar code marking 28 of the ink ribbon cassette 6. As is apparent from FIG. 6, the marking 28 of the ink ribbon cassette 6 can be easily applied to a label 30 which is cemented at a given position on the ink ribbon cassette 6, for example on the cylindrical cover 22 of the feed spool 20. In addition an item designation or a logo can be applied to the label 30.

Figure 5A:
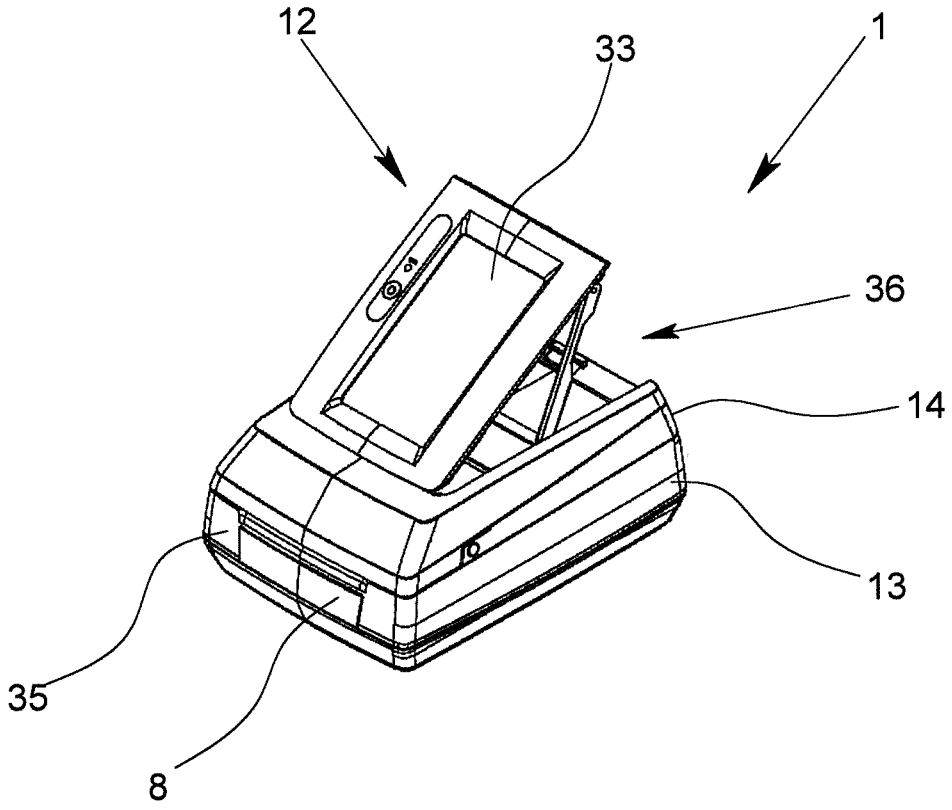
FIGS. 5*a* and 5*b* show one exemplary embodiment of the printer with the input and display apparatus swung up, obliquely from the front and from the side.
Figure 5B:
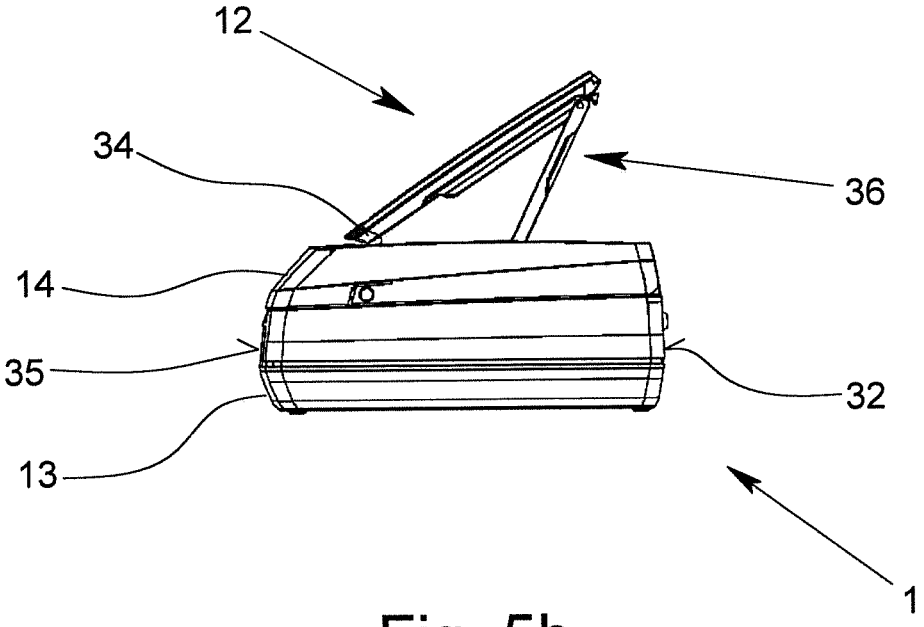

In the preferred configurations of the printer 1 which are shown in FIGS. 2 to 5*a* and 5*b*, the upper part 14 of the housing is pivotably mounted on the lower part 13 of the housing, specifically around an axis of rotation 31 which is located in the vicinity of the back 32 of the printer 1. Moreover, as is apparent from FIG. 5, the input and display apparatus 12 is made as a tablet computer which has a touch screen 33 and which can be pivoted around an axis 34 of rotation on the upper part 14 of the housing. The axis 34 of rotation of the tablet computer 12 is located in the vicinity of the front 35 of the printer 1 in which the receiving device 8 is also located so that the tablet computer 12 in the swung-up position shown in FIGS. 5*a* and 5*b* is facing a user who is located in front 35 of the face of the printer 1 from where he will also insert a printable object 2 into the extended receiving device 8.

To support and lock the tablet computer 12 in the swung-up position, there is a U-shaped bracket 36 pivotably located on the back of the tablet computer 12. A latch made between the bracket 36 and the top of the upper part 14 of the housing provides for the locking of the tablet computer 12 in the swung-up position.

It is apparent from the representation of the ink ribbon cassette 6 according to FIG. 6 that the cassette body 23 is made frame-like and has bearing shells 37, 38 for holding the journals 39, 40 which are located on the main spool 19 and the feed spool 21. Between the main spool 19 and the feed spool 21 a window region 41 is made in the cassette body 23 so that the print head 5 in its working position is located directly above the ink ribbon 7. Moreover it is apparent from the representation of the ink ribbon cassette 6 in FIG. 6 that a journal 39 of the main spool 19 is connected to a slotted sensor wheel 42 and a journal 40 of the feed spool 21 is connected to a gear 43. The feed spool 21 can be driven via the gear 43 and a drive gear which is located in the housing 3 or in the lower part 13 of the housing of the printer 1, the then resulting transport of the ink ribbon 7 being detectable by an optical sensor which is located in the lower part 13 of the housing and which detects the rotary motion of the slotted sensor wheel 42.

What is claimed is:

1. A printer for printing of printable objects for identification of electrical components, the printer comprising:

a housing, a print space within the housing, a print head, a replaceable ink ribbon cassette, a receiving device for a printable object which is to be printed, a control and evaluation unit, and an input and display apparatus, wherein the receiving device is movable between a loading and unloading position outside the print space and a print position within the print space, wherein a print head holder on whose bottom side the print head is attached is pivotably mounted in the housing such that in a closed position of the print head holder the print head is located in a working position above the ink ribbon cassette, and in a swung-up position of the print head holder an ink ribbon cassette can be inserted into the housing or can be removed from the housing, and wherein at least one spring arm is formed on the top of the ink ribbon cassette or on the bottom side of the print head holder such that the spring arm is deflected in the closed position of the print head holder such that the ink ribbon cassette has a given distance to the print head.

2. The printer as claimed in claim 1, wherein:

the ink ribbon cassette comprises an ink ribbon, a main spool with a cover, a feed spool with a cover and a cassette body, at least one spring arm is formed on each of the covers, and in an undeflected state of the spring arms a free end of the spring arms projects over a top of the covers.

3. The printer as claimed in claim 1, wherein there is at least one locking lever movable out of a first position in which the print head holder is locked in the closed position into a second position in which the print head holder can be swung.

4. The printer as claimed in claim 1, wherein in the housing there is at least one optical sensor for detecting a marking which is located on the ink ribbon cassette.

5. The printer as claimed in claim 1, wherein in the housing there is at least one optical sensor which is used to detect a rotary motion of a slotted sensor wheel which is connected to a main spool of the ink ribbon cassette.

6. The printer as claimed in claim 1, wherein:

the housing has a lower part and an upper part, the print space, the print head, the ink ribbon cassette, the receiving device, and the control and evaluation unit are located in the lower part of the housing, and that the upper part of the housing contains the input and display apparatus and can be pivoted around an axis of rotation on the lower part of the housing, the axis of rotation of the upper part of the housing being located in a vicinity of a back of the printer facing away from the receiving device.

7. An ink ribbon cassette for use in a printer as claimed in claim 1, the ink ribbon cassette comprising an ink ribbon, a main spool, a feed spool, and a cassette body, wherein:

the main spool and the feed spool are each covered by a respective one of two covers, the at least one spring arm is formed on each of the two covers, and a free end of each of the at least one spring arm, in an undeflected state of the spring arm, extends above a top of the two covers.

8. The ink ribbon cassette as claimed in claim 7, wherein the cassette body is frame-like and comprises: two bearing shells for holding journals that are located on the main spool and the feed spool, and a window region for access of the print head of the printer to the ink ribbon.

9. The ink ribbon cassette as claimed in claim 7, wherein the main spool is connected to a slotted sensor wheel.

10. The ink ribbon cassette as claimed in claim 7, wherein the feed spool is connected to a gear which can be driven by a drive gear which is located in the housing of the printer.

11. The ink ribbon cassette as claimed in claim 7, wherein each of the at least one spring arm is stamped out of a respective one of the two covers.

12. The printer as claimed in claim 2, wherein the spring arms are stamped out of the covers.

* * * * *